US010761463B2

(12) United States Patent
Furuichi

(10) Patent No.: US 10,761,463 B2
(45) Date of Patent: Sep. 1, 2020

(54) HEATING DEVICE, FIXING DEVICE, AND IMAGE FORMING APPARATUS

(71) Applicant: Yuusuke Furuichi, Kanagawa (JP)

(72) Inventor: Yuusuke Furuichi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/550,346

(22) Filed: Aug. 26, 2019

(65) Prior Publication Data

US 2020/0117124 A1 Apr. 16, 2020

(30) Foreign Application Priority Data

Oct. 10, 2018 (JP) ..... 2018-191714

(51) Int. Cl.
*G03G 15/20* (2006.01)
*G03G 15/00* (2006.01)

(52) U.S. Cl.
CPC ..... *G03G 15/2046* (2013.01); *G03G 15/2053* (2013.01); *G03G 15/657* (2013.01)

(58) Field of Classification Search
None
See application file for complete search history.

(56) References Cited

U.S. PATENT DOCUMENTS 6,337,969 B1 * 1/2002 Takagi ..... G03G 15/2053 219/619
2003/0091855 A1 * 5/2003 Tanaka ..... B32B 15/01 428/647
2011/0097102 A1 * 4/2011 Koshida ..... G03G 15/6573 399/92
2014/0105623 A1 * 4/2014 Kim ..... G03G 15/205 399/33

FOREIGN PATENT DOCUMENTS

JP 2000-268940 9/2000

OTHER PUBLICATIONS

U.S. Appl. No. 16/263,634, filed Jan. 31, 2019, Yuusuke Furuichi, et al.
U.S. Appl. No. 16/269,616, filed Feb. 7, 2019, Tomoya Adachi, et al.
U.S. Appl. No. 16/285,733, filed Feb. 26, 2019, Yuusuke Furuichi, et al.
U.S. Appl. No. 16/352,390, filed Mar. 13, 2019, Tomoya Adachi, et al.
U.S. Appl. No. 16/391,959, filed Apr. 23, 2019, Takamasa Hase, et al.
U.S. Appl. No. 16/520,409, filed Jul. 24, 2019, Hiroshi Yoshinaga, et al.
U.S. Appl. No. 16/502,473, filed Jul. 3, 2019, Yuusuke Furuichi, et al.
U.S. Appl. No. 16/519,254, filed Jul. 23, 2019, Daisuke Inoue, et al.
U.S. Appl. No. 16/451,512, filed Jun. 25, 2019, Tomoya Adachi, et al.
U.S. Appl. No. 16/502,348, filed Jul. 3, 2019, Yuusuke Furuichi, et al.

* cited by examiner

*Primary Examiner* — Roy Y Yi

(74) *Attorney, Agent, or Firm* — Oblon, McClelland, Maier & Neustadt, L.L.P.

(57) ABSTRACT

A heating device includes a heater that includes a heat generator configured to generate heat as the heat generator is supplied with power. A feeding member is configured to contact the heater and feed the power to the heat generator. The feeding member is made of a corson copper alloy.

20 Claims, 12 Drawing Sheets

HEATING DEVICE, FIXING DEVICE, AND IMAGE FORMING APPARATUS

CROSS-REFERENCE TO RELATED APPLICATION

This patent application is based on and claims priority pursuant to 35 U.S.C. § 119(a) to Japanese Patent Application No. 2018-191714, filed on Oct. 10, 2018, in the Japan Patent Office, the entire disclosure of which is hereby incorporated by reference herein.

BACKGROUND

Technical Field

Exemplary aspects of the present disclosure relate to a heating device, a fixing device, and an image forming apparatus.

Discussion of the Background Art

Related-art image forming apparatuses, such as copiers, facsimile machines, printers, and multifunction peripherals (MFP) having two or more of copying, printing, scanning, facsimile, plotter, and other functions, typically form an image on a recording medium according to image data by electrophotography.

Such image forming apparatuses include a fixing device that fixes a toner image on a sheet serving as a recording medium under heat or a dryer that dries ink on a sheet. The fixing device and the dryer employ a laminated heater incorporating a laminated, resistive heat generator as a heater installed in the fixing device and the dryer.

The laminated heater is coupled to a feeding member that supplies power to the resistive heat generator. The feeding member is a resilient member such as a flat spring. As the feeding member resiliently contacts an electrode disposed in the laminated heater, conduction is established at a contact between the feeding member and the electrode, supplying power from a power supply to the resistive heat generator.

However, since the feeding member is under high temperatures, if the feeding member suffers from temperature increase and resultant creep deformation, the feeding member may not attain a desired resilience. In this case, contact pressure with which the feeding member contacts the electrode of the laminated heater decreases, causing faulty contact and faulty conduction.

The feeding member may suffer from temperature increase due to heat generation of the feeding member as the feeding member is supplied with power, other than conduction of heat from the laminated heater as described above. Hence, in order to suppress temperature increase of the feeding member further, the feeding member is requested to decrease heat generation while the feeding member is supplied with power, in addition to conduction of heat from the laminated heater.

SUMMARY

This specification describes below an improved heating device. In one embodiment, the heating device includes a heater that includes a heat generator configured to generate heat as the heat generator is supplied with power. A feeding member is configured to contact the heater and feed the power to the heat generator. The feeding member is made of a corson copper alloy. This specification further describes an improved fixing device. In one embodiment, the fixing device includes an endless belt configured to rotate and an opposed rotator configured to contact the endless belt to form a fixing nip between the endless belt and the opposed rotator, through which a recording medium bearing an image is conveyed. A laminated heater is configured to heat the endless belt. The laminated heater includes a heat generator configured to generate heat as the heat generator is supplied with power. A feeding member is configured to contact the laminated heater and feed the power to the heat generator. The feeding member is made of a corson copper alloy.

This specification further describes an improved image forming apparatus. In one embodiment, the image forming apparatus includes an image forming device configured to form an image and a heating device configured to heat the image borne on a recording medium. The heating device includes a heater that includes a heat generator configured to generate heat as the heat generator is supplied with power. A feeding member is configured to contact the heater and feed the power to the heat generator. The feeding member is made of a corson copper alloy.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

Figure 1:
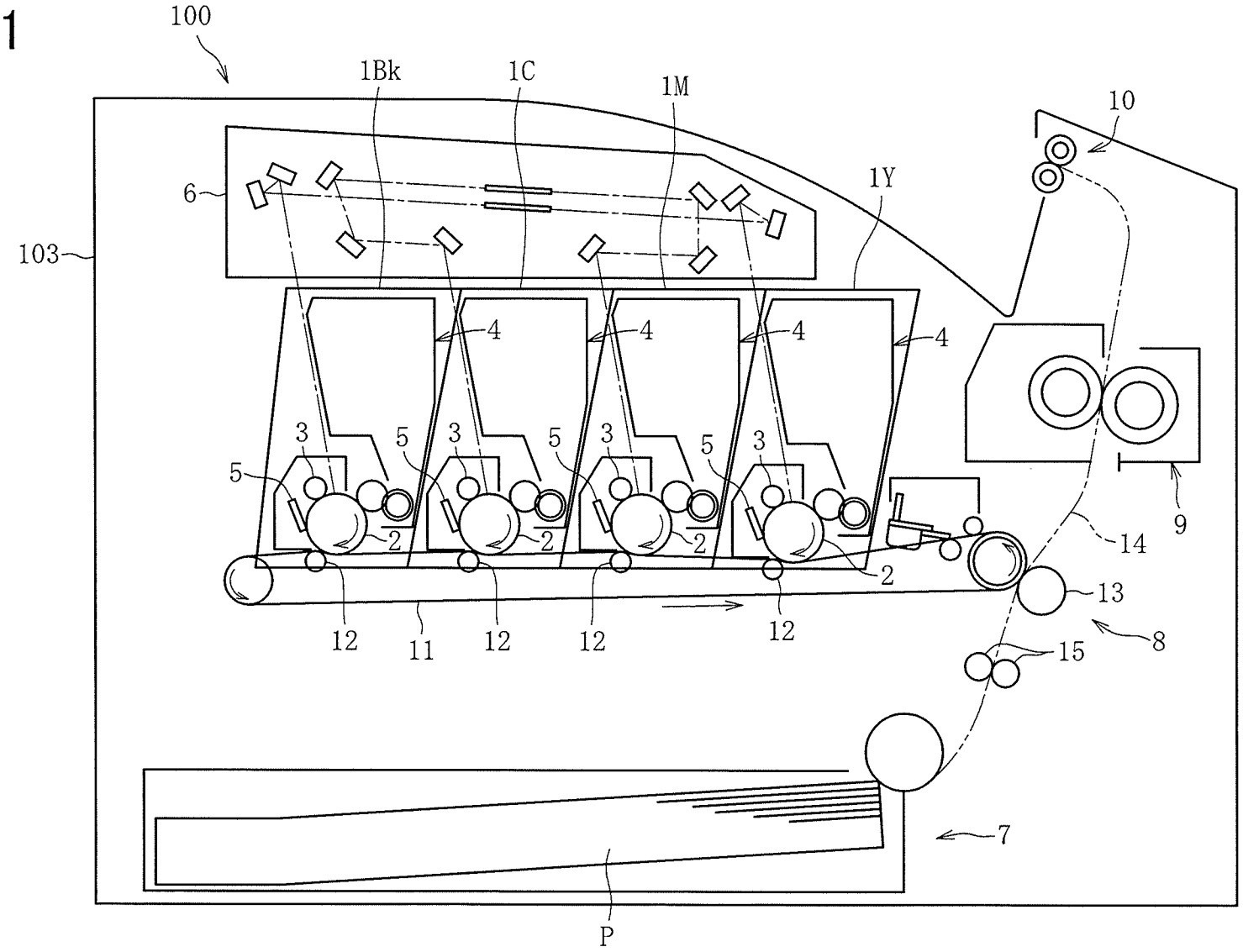
FIG. 1 is a schematic cross-sectional view of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Referring to the attached drawings, the following describes a construction of an image forming apparatus 100 according to embodiments of the present disclosure.

In the drawings for explaining the embodiments of the present disclosure, identical reference numerals are assigned to elements such as members and parts that have an identical function or an identical shape as long as differentiation is possible and a description of those elements is omitted once the description is provided.

FIG. 1 is a schematic cross-sectional view of the image forming apparatus 100 according to an embodiment of the present disclosure. The image forming apparatus 100 is a printer. Alternatively, the image forming apparatus 100 may be a copier, a facsimile machine, a multifunction peripheral (MFP) having at least two of printing, copying, facsimile, scanning, and plotter functions, or the like.

As illustrated in FIG. 1, the image forming apparatus 100 includes four image forming units 1Y, 1M, 1C, and 1Bk serving as image forming devices, respectively. The image forming units 1Y, 1M, 1C, and 1Bk are removably installed in a body 103 of the image forming apparatus 100. The image forming units 1Y, 1M, 1C, and 1Bk have a similar construction except that the image forming units 1Y, 1M, 1C, and 1Bk contain developers in different colors, that is, yellow, magenta, cyan, and black, respectively, which correspond to color separation components for a color image. For example, each of the image forming units 1Y, 1M, 1C, and 1Bk includes a photoconductor 2, a charger 3, a developing device 4, and a cleaner 5. The photoconductor 2 is drum-shaped and serves as an image bearer. The charger 3 charges a surface of the photoconductor 2. The developing device 4 supplies toner as a developer to the surface of the photoconductor 2 to form a toner image. The cleaner 5 cleans the surface of the photoconductor 2.

The image forming apparatus 100 further includes an exposure device 6, a sheet feeding device 7, a transfer device 8, a fixing device 9, and a sheet ejection device 10. The exposure device 6 exposes the surface of each of the photoconductors 2 and forms an electrostatic latent image thereon. The sheet feeding device 7 supplies a sheet P serving as a recording medium or a conveyed medium to the transfer device 8. The transfer device 8 transfers the toner image formed on each of the photoconductors 2 onto the sheet P. The fixing device 9 fixes the toner image transferred onto the sheet P thereon. The sheet ejection device 10 ejects the sheet P onto an outside of the image forming apparatus 100.

The transfer device 8 includes an intermediate transfer belt 11, four primary transfer rollers 12, and a secondary transfer roller 13. The intermediate transfer belt 11 is an endless belt serving as an intermediate transferor stretched taut across a plurality of rollers. The four primary transfer rollers 12 serve as primary transferors that transfer yellow, magenta, cyan, and black toner images formed on the photoconductors 2 onto the intermediate transfer belt 11, respectively, thus forming a full color toner image on the intermediate transfer belt 11. The secondary transfer roller 13 serves as a secondary transferor that transfers the full color toner image formed on the intermediate transfer belt 11 onto the sheet P. The plurality of primary transfer rollers 12 is pressed against the photoconductors 2, respectively, via the intermediate transfer belt 11. Thus, the intermediate transfer belt 11 contacts each of the photoconductors 2, forming a primary transfer nip therebetween. On the other hand, the secondary transfer roller 13 is pressed against one of the rollers across which the intermediate transfer belt 11 is stretched taut via the intermediate transfer belt 11. Thus, a secondary transfer nip is formed between the secondary transfer roller 13 and the intermediate transfer belt 11.

The image forming apparatus 100 accommodates a sheet conveyance path 14 through which the sheet P fed from the sheet feeding device 7 is conveyed. A timing roller pair 15 is disposed in the sheet conveyance path 14 at a position between the sheet feeding device 7 and the secondary transfer nip defined by the secondary transfer roller 13.

Referring to FIG. 1, a description is provided of printing processes performed by the image forming apparatus 100 having the construction described above.

When the image forming apparatus 100 receives an instruction to start printing, a driver drives and rotates the photoconductor 2 clockwise in FIG. 1 in each of the image forming units 1Y, 1M, 1C, and 1Bk. The charger 3 charges the surface of the photoconductor 2 uniformly at a high electric potential. Subsequently, the exposure device 6 exposes the surface of each of the photoconductors 2 based on image data created by an original scanner that reads an image on an original or print data instructed by a terminal, thus decreasing the electric potential of an exposed portion on the photoconductor 2 and forming an electrostatic latent image on the photoconductor 2. The developing device 4 supplies toner to the electrostatic latent image formed on the photoconductor 2, forming a toner image thereon.

When the toner images formed on the photoconductors 2 reach the primary transfer nips defined by the primary transfer rollers 12 in accordance with rotation of the photoconductors 2, the toner images formed on the photoconductors 2 are transferred onto the intermediate transfer belt 11 driven and rotated counterclockwise in FIG. 1 successively such that the toner images are superimposed on the intermediate transfer belt 11, forming a full color toner image thereon.

Thereafter, the full color toner image formed on the intermediate transfer belt 11 is conveyed to the secondary transfer nip defined by the secondary transfer roller 13 in accordance with rotation of the intermediate transfer belt 11 and is transferred onto a sheet P conveyed to the secondary transfer nip. The sheet P is supplied from the sheet feeding device 7. The timing roller pair 15 temporarily halts the sheet P supplied from the sheet feeding device 7. Thereafter, the timing roller pair 15 conveys the sheet P to the secondary transfer nip at a time when the full color toner image formed on the intermediate transfer belt 11 reaches the secondary transfer nip. Accordingly, the full color toner image is transferred onto and borne on the sheet P. After the toner image is transferred onto the intermediate transfer belt 11, the cleaner 5 removes residual toner remained on the photoconductor 2 therefrom.

The sheet P transferred with the full color toner image is conveyed to the fixing device 9 that fixes the full color toner image on the sheet P. Thereafter, the sheet ejection device 10 ejects the sheet P onto the outside of the image forming apparatus 100, thus finishing a series of printing processes.

A description is provided of a construction of the fixing device 9.

Figure 2:
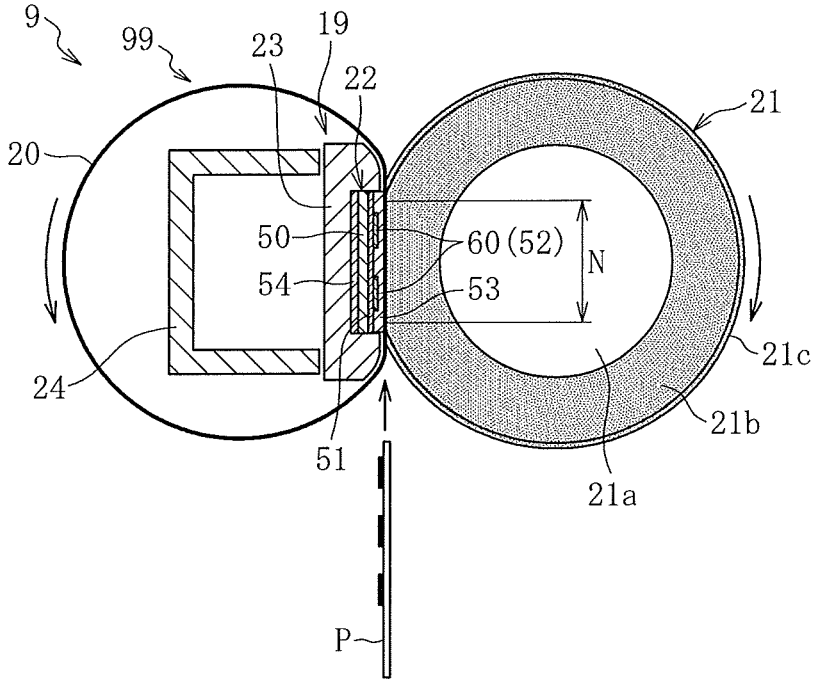
FIG. 2 is a schematic cross-sectional view of a fixing device incorporated in the image forming apparatus depicted in FIG. 1.

As illustrated in FIG. 2, the fixing device 9 according to this embodiment includes a fixing belt 20, a pressure roller 21, and a heating device 19. The fixing belt 20 is an endless belt serving as a fixing rotator or a fixing member. The pressure roller 21 serves as an opposed rotator or an opposed member that contacts an outer circumferential surface of the fixing belt 20 to form a nip, that is, a fixing nip N, between the fixing belt 20 and the pressure roller 21. The heating device 19 heats the fixing belt 20. The heating device 19 includes a heater 22, a heater holder 23, and a stay 24. The heater 22 is a laminated heater and serves as a heater or a heating member. The heater holder 23 serves as a holder that holds or supports the heater 22. The stay 24 serves as a reinforcement that reinforces the heater holder 23 throughout an entire width of the heater holder 23 in a longitudinal direction thereof. Alternatively, the fixing device 9 may be a heating device 99 that includes a driving roller (e.g., the pressure roller 21).

A detailed description is now given of a construction of the fixing belt 20.

The fixing belt 20 includes a tubular base that is made of polyimide (PI) and has an outer diameter of 25 mm and a thickness in a range of from 40 micrometers to 120 micrometers, for example. The fixing belt 20 further includes a release layer serving as an outermost surface layer. The release layer is made of fluororesin, such as tetrafluoroethylene-perfluoroalkylvinylether copolymer (PFA) and polytetrafluoroethylene (PTFE), and has a thickness in a range of from 5 micrometers to 50 micrometers to enhance durability of the fixing belt 20 and facilitate separation of the sheet P and a foreign substance from the fixing belt 20. Optionally, an elastic layer that is made of rubber or the like and has a thickness in a range of from 50 micrometers to 500 micrometers may be interposed between the base and the release layer. The base of the fixing belt 20 may be made of heat resistant resin such as polyetheretherketone (PEEK) or metal such as nickel (Ni) and SUS stainless steel, instead of polyimide. An inner circumferential surface of the fixing belt 20 may be coated with polyimide, PTFE, or the like to produce a slide layer.

A detailed description is now given of a construction of the pressure roller 21.

The pressure roller 21 has an outer diameter of 25 mm, for example. The pressure roller 21 includes a cored bar 21*a*, an elastic layer 21*b*, and a release layer 21*c*. The cored bar 21*a* is solid and made of metal such as iron. The elastic layer 21*b* is disposed on a surface (e.g., an outer periphery) of the cored bar 21*a*. The release layer 21*c* coats an outer surface of the elastic layer 21*b*. The elastic layer 21*b* is made of silicone rubber and has a thickness of 3.5 mm, for example. In order to facilitate separation of the sheet P and the foreign substance from the pressure roller 21, the release layer 21*c* that is made of fluororesin and has a thickness of about 40 micrometers, for example, is preferably disposed on the outer surface of the elastic layer 21*b*.

A detailed description is now given of a construction of the heater 22.

The heater 22 extends in a longitudinal direction thereof throughout an entire width of the fixing belt 20 in a width direction, that is, an axial direction, of the fixing belt 20. The heater 22 contacts the inner circumferential surface of the fixing belt 20. The heater 22 may not contact the fixing belt 20 or may be disposed opposite the fixing belt 20 indirectly via a low friction sheet or the like. However, the heater 22 that contacts the fixing belt 20 directly enhances conduction of heat from the heater 22 to the fixing belt 20. The heater 22 may contact the outer circumferential surface of the fixing belt 20. However, if the outer circumferential surface of the fixing belt 20 is brought into contact with the heater 22 and damaged, the fixing belt 20 may degrade quality of fixing the toner image on the sheet P. Hence, the heater 22 contacts the inner circumferential surface of the fixing belt 20 advantageously.

The heater 22 includes a base layer 50, a first insulating layer 51, a conductor layer 52, a second insulating layer 53, and a third insulating layer 54. The first insulating layer 51, the conductor layer 52, and the second insulating layer 53 are layered on the base layer 50 in this order and sandwiched between the base layer 50 and the fixing nip N. The conductor layer 52 includes a heat generator 60. The third insulating layer 54 is layered on the base layer 50 and is disposed opposite the fixing nip N via the base layer 50.

A detailed description is now given of a construction of the heater holder 23 and the stay 24.

The heater holder 23 and the stay 24 are disposed inside a loop formed by the fixing belt 20. The stay 24 includes a channel made of metal. Both lateral ends of the stay 24 in a longitudinal direction thereof are supported by side walls (e.g., side plates) of the fixing device 9, respectively. The stay 24 supports a stay side face of the heater holder 23, that faces the stay 24 and is opposite a heater side face of the heater holder 23, that faces the heater 22. Accordingly, the stay 24 retains the heater 22 and the heater holder 23 to be immune from being bent substantially by pressure from the pressure roller 21, forming the fixing nip N between the fixing belt 20 and the pressure roller 21. According to this embodiment, the heater 22 and the pressure roller 21 sandwich the fixing belt 20. Thus, the heater 22 disposed opposite the inner circumferential surface of the fixing belt 20 serves as a nip former (e.g., a nip forming pad) that forms the fixing nip N between the fixing belt 20 and the pressure roller 21. Hence, the heater 22 downsizes the fixing device 9 compared to a construction described below with reference to FIG. 17, in which the heater 22 is provided separately from a nip forming pad 91.

Since the heater holder 23 is subject to temperature increase by heat from the heater 22, the heater holder 23 is preferably made of a heat resistant material. For example, if the heater holder 23 is made of heat resistant resin having a decreased thermal conductivity, such as liquid crystal polymer (LCP) and PEEK, the heater holder 23 suppresses conduction of heat thereto from the heater 22, facilitating heating of the fixing belt 20.

A spring serving as a biasing member causes the fixing belt 20 and the pressure roller 21 to press against each other. Thus, the fixing nip N is formed between the fixing belt 20 and the pressure roller 21. As a driving force is transmitted to the pressure roller 21 from a driver disposed inside the body 103 of the image forming apparatus 100, the pressure roller 21 serves as a driving roller that drives and rotates the fixing belt 20. The fixing belt 20 is driven and rotated by the pressure roller 21 as the pressure roller 21 rotates. While the fixing belt 20 rotates, the fixing belt 20 slides over the heater 22. In order to facilitate sliding of the fixing belt 20, a lubricant such as oil and grease may be interposed between the heater 22 and the fixing belt 20.

When printing starts, the driver drives and rotates the pressure roller 21 and the fixing belt 20 starts rotation in accordance with rotation of the pressure roller 21. Additionally, as power is supplied to the heater 22, the heater 22 heats the fixing belt 20. In a state in which the temperature of the fixing belt 20 reaches a predetermined target temperature (e.g., a fixing temperature), as the sheet P bearing the unfixed toner image is conveyed through the fixing nip N formed between the fixing belt 20 and the pressure roller 21 as illustrated in FIG. 2, the fixing belt 20 and the pressure roller 21 fix the unfixed toner image on the sheet P under heat and pressure.

Figure 3:
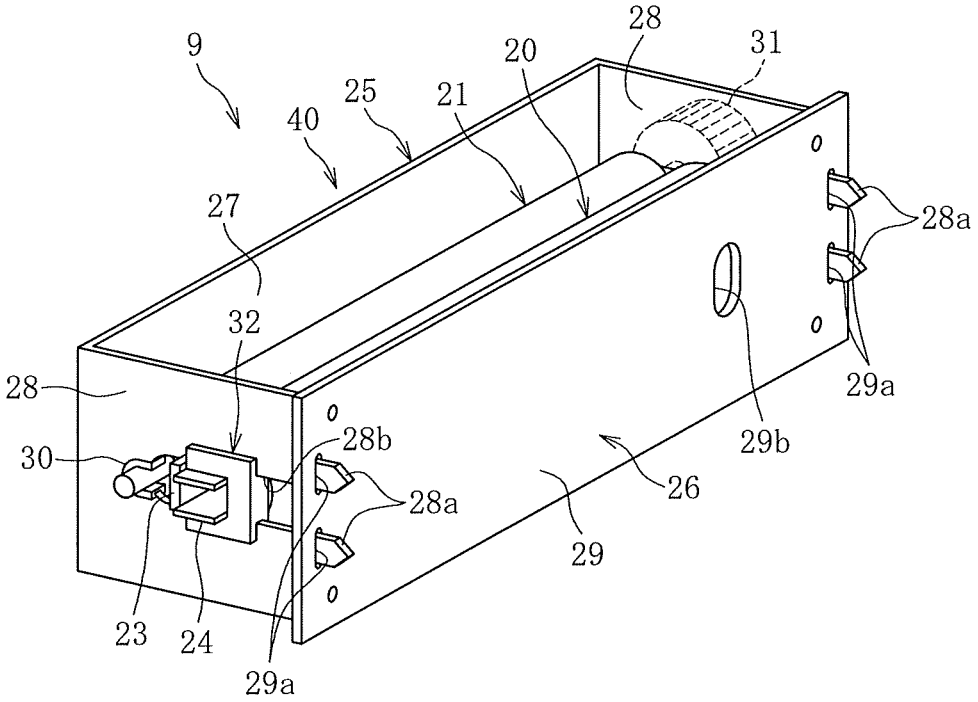
FIG. 3 is a perspective view of the fixing device depicted in FIG. 2.
Figure 4:
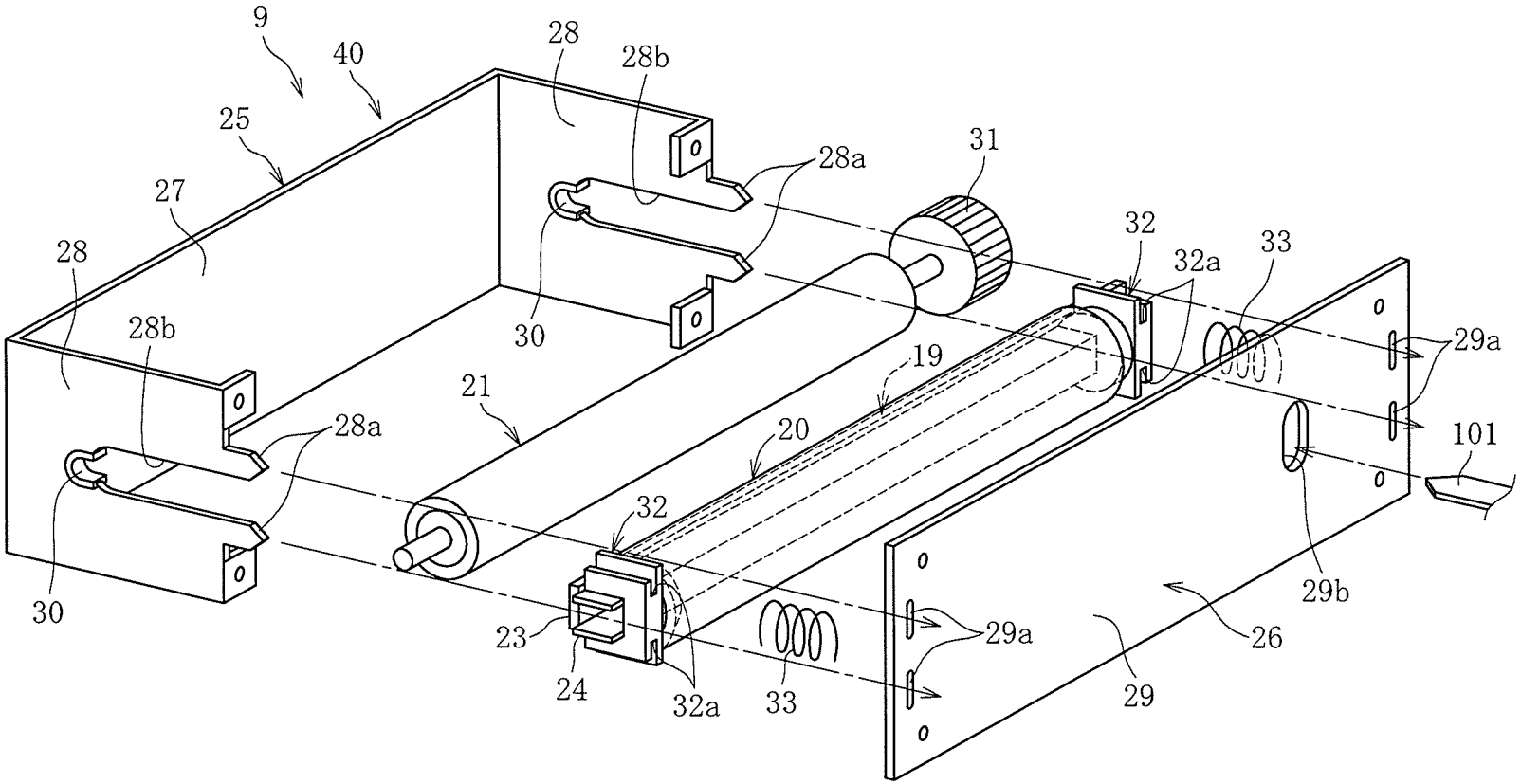
FIG. 4 is an exploded perspective view of the fixing device depicted in FIG. 3.

FIG. 3 is a perspective view of the fixing device 9. FIG. 4 is an exploded perspective view of the fixing device 9.

As illustrated in FIGS. 3 and 4, the fixing device 9 includes a device frame 40 that includes a first device frame 25 and a second device frame 26. The first device frame 25 includes a pair of side walls 28 and a front wall 27. The second device frame 26 includes a rear wall 29. The side walls 28 are disposed at one lateral end and another lateral end of the fixing belt 20, respectively, in the width direction of the fixing belt 20. The side walls 28 support both lateral ends of each of the pressure roller 21 and the heating device 19, respectively. Each of the side walls 28 includes a plurality of engaging projections 28*a*. As the engaging projections 28*a* engage engaging holes 29*a* penetrating through the rear wall 29, respectively, the first device frame 25 is coupled to the second device frame 26.

Each of the side walls 28 includes an insertion recess 28*b* through which a rotation shaft and the like of the pressure roller 21 are inserted. The insertion recess 28*b* is open at an opening that faces the rear wall 29 and closed at a bottom that is opposite the opening and serves as a contact portion. A bearing 30 that supports the rotation shaft of the pressure roller 21 is disposed at an end of the insertion recess 28*b*, that serves as the contact portion. As both lateral ends of the rotation shaft of the pressure roller 21 in an axial direction thereof are attached to the bearings 30, respectively, the side walls 28 rotatably support the pressure roller 21.

A driving force transmission gear 31 serving as a driving force transmitter is disposed at one lateral end of the rotation shaft of the pressure roller 21 in the axial direction thereof. In a state in which the side walls 28 support the pressure roller 21, the driving force transmission gear 31 is exposed outside the side wall 28. Accordingly, when the fixing device 9 is installed in the body 103 of the image forming apparatus 100, the driving force transmission gear 31 is coupled to a gear disposed inside the body 103 of the image forming apparatus 100 so that the driving force transmission gear 31 transmits the driving force from the driver. Alternatively, a driving force transmitter that transmits the driving force to the pressure roller 21 may be pulleys over which a driving force transmission belt is stretched taut, a coupler, and the like instead of the driving force transmission gear 31.

A pair of supports 32 that supports the fixing belt 20 and the like is disposed at both lateral ends of the heating device 19 in a longitudinal direction thereof, respectively. Each of the supports 32 is a device frame of the heating device 19 and a part of the device frame 40 of the fixing device 9. The supports 32 support the fixing belt 20 in a state in which the fixing belt 20 is not basically applied with tension in a circumferential direction thereof while the fixing belt 20 does not rotate, that is, by a free belt system. Each of the supports 32 includes guide grooves 32*a*. As the guide grooves 32*a* move along edges of the insertion recess 28*b* of the side wall 28, respectively, the support 32 is attached to the side wall 28.

A pair of springs 33 serving as a pair of biasing members is interposed between each of the supports 32 and the rear wall 29. As the springs 33 bias the stay 24 and the supports 32 toward the pressure roller 21, respectively, the fixing belt 20 is pressed against the pressure roller 21 to form the fixing nip N between the fixing belt 20 and the pressure roller 21.

As illustrated in FIG. 4, a hole 29*b* is disposed at one lateral end of the rear wall 29 of the second device frame 26 in a longitudinal direction of the second device frame 26. The hole 29*b* serves as a positioner that positions a body of the fixing device 9 with respect to the body 103 of the image forming apparatus 100. When the body of the fixing device 9 is installed inside the body 103 of the image forming apparatus 100, a projection 101 serving as a positioner disposed inside the body 103 of the image forming apparatus 100 is inserted into the hole 29*b* of the fixing device 9. Accordingly, the projection 101 engages the hole 29*b*, positioning the body of the fixing device 9 with respect to the body 103 of the image forming apparatus 100 in a longitudinal direction of the fixing device 9, that is, the width direction or the axial direction of the fixing belt 20. Although the hole 29*b* serving as a positioner is disposed at one lateral end of the rear wall 29 in the longitudinal direction of the second device frame 26, a positioner is not disposed at another lateral end of the rear wall 29. Thus, the second device frame 26 does not restrict thermal expansion and shrinkage of the body of the fixing device 9 in the longitudinal direction thereof due to temperature change.

Figure 5:
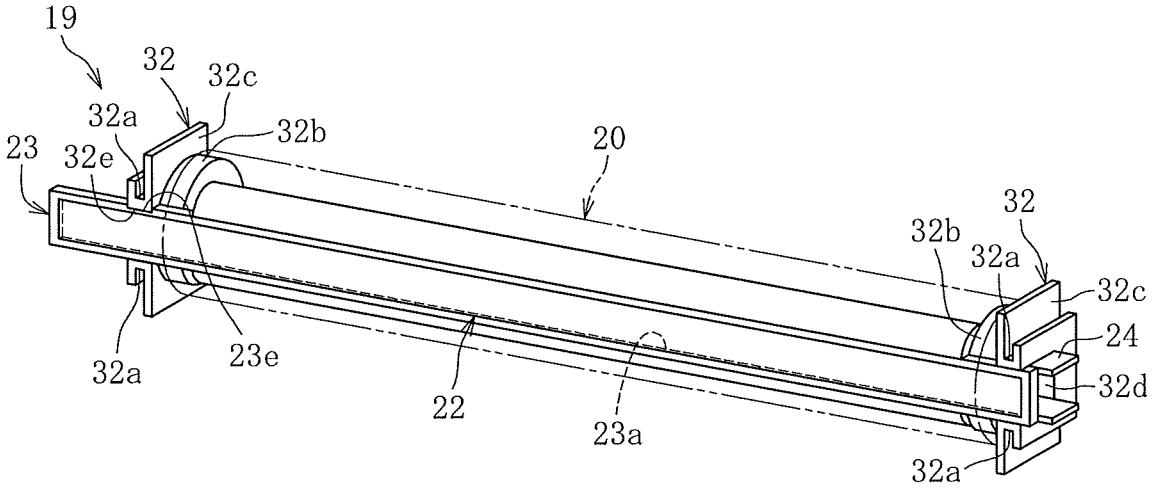
FIG. 5 is a perspective view of a heating device incorporated in the fixing device depicted in FIG. 2.
Figure 6:
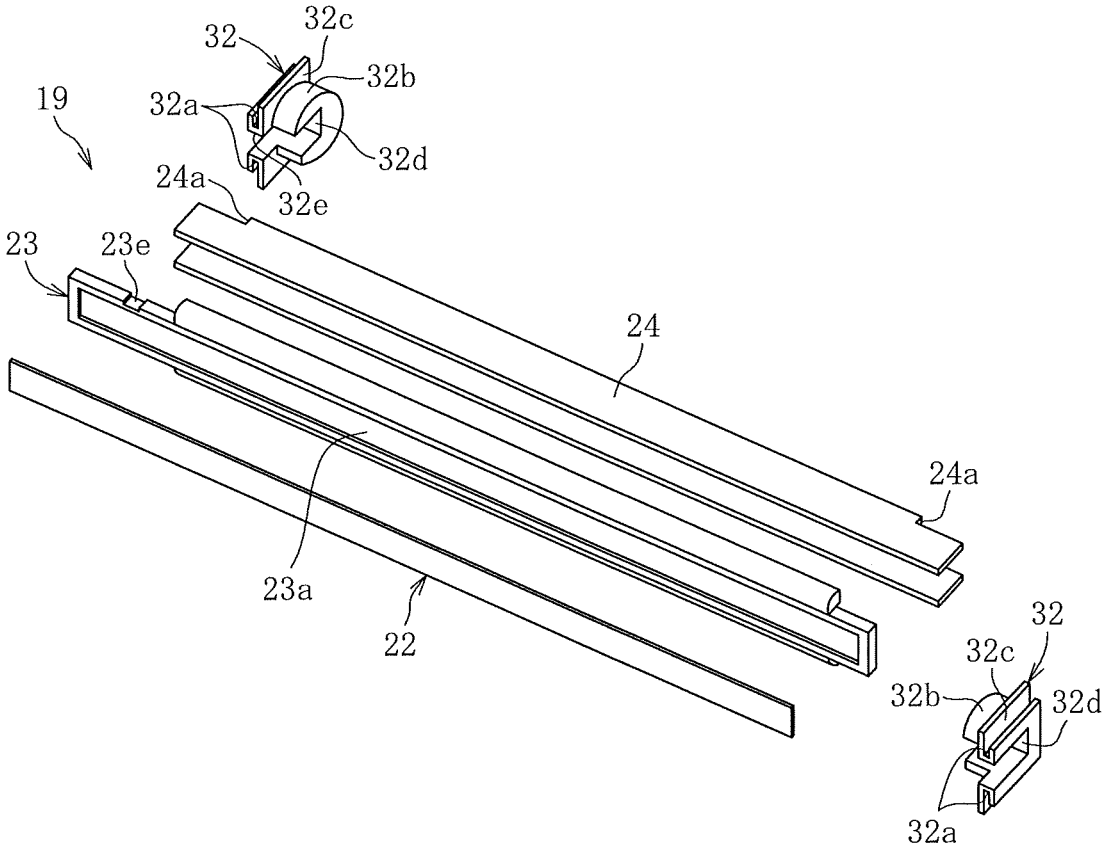
FIG. 6 is an exploded perspective view of the heating device depicted in FIG. 5.

FIG. 5 is a perspective view of the heating device 19. FIG. 6 is an exploded perspective view of the heating device 19.

As illustrated in FIGS. 5 and 6, the heater holder 23 includes an accommodating recess 23*a* disposed on a belt side face of the heater holder 23, that faces the fixing belt 20 and the fixing nip N. The accommodating recess 23*a* is rectangular and accommodates the heater 22. A connector described below sandwiches the heater 22 and the heater holder 23 in a state in which the accommodating recess 23*a* accommodates the heater 22, thus holding the heater 22.

Each of the pair of supports 32 includes a belt support 32*b*, a belt restrictor 32*c*, and a supporting recess 32*d*. The belt support 32*b* is C-shaped and inserted into the loop formed by the fixing belt 20, thus contacting the inner circumferential surface of the fixing belt 20 to support the fixing belt 20. The belt restrictor 32*c* is a flange that contacts an edge face of the fixing belt 20 to restrict motion (e.g., skew) of the fixing belt 20 in the width direction of the fixing belt 20. The supporting recess 32*d* is inserted with a lateral end of each of the heater holder 23 and the stay 24 in the longitudinal direction thereof, thus supporting the heater holder 23 and the stay 24.

As illustrated in FIGS. 5 and 6, the heater holder 23 includes a positioning recess 23*e*, serving as a positioner, disposed at one lateral end of the heater holder 23 in the longitudinal direction thereof. The support 32 includes an engagement 32*e* illustrated in a left part in FIGS. 5 and 6. The engagement 32*e* engages the positioning recess 23*e*, positioning the heater holder 23 with respect to the support 32 in the longitudinal direction of the heater holder 23. The support 32 illustrated in a right part in FIGS. 5 and 6 does not include the engagement 32*e* and therefore the heater holder 23 is not positioned with respect to the support 32 in the longitudinal direction of the heater holder 23. Thus, the support 32 does not restrict thermal expansion and shrinkage of the heater holder 23 in the longitudinal direction thereof due to temperature change.

As illustrated in FIG. 4, as the guide grooves 32*a* of the support 32 move along the insertion recess 28*b* of the side wall 28, the support 32 is attached to the side wall 28 disposed at each lateral end of the device frame 40 in a longitudinal direction thereof. The support 32, situated at a rear position in FIG. 4, of the two supports 32 illustrated in FIG. 4 positions the heater holder 23 in the longitudinal direction thereof. As the support 32 situated at the rear position in FIG. 4 is attached to the side wall 28, the heater holder 23 is positioned with respect to the side wall 28 in the longitudinal direction of the heater holder 23. Thus, the side wall 28 and the support 32 serve as positioners that position the heater holder 23 with respect to the body of the fixing device 9 in the longitudinal direction of the heater holder 23.

The stay 24 is not positioned with respect to the support 32 in the longitudinal direction of the stay 24. As illustrated in FIG. 6, the stay 24 includes steps 24*a* disposed at both lateral ends of the stay 24 in the longitudinal direction thereof, respectively. The steps 24*a* restrict motion (e.g., dropping) of the stay 24 with respect to the supports 32, respectively, in the longitudinal direction of the stay 24. A gap is provided between the step 24*a* and at least one of the supports 32 in the longitudinal direction of the stay 24. For example, the stay 24 is attached to the supports 32 such that looseness is provided between the stay 24 and each of the supports 32 in the longitudinal direction of the stay 24 so that the supports 32 do not restrict thermal expansion and shrinkage of the stay 24 in the longitudinal direction thereof due to temperature change. That is, the stay 24 is not positioned with respect to one of the supports 32.

Figure 7:
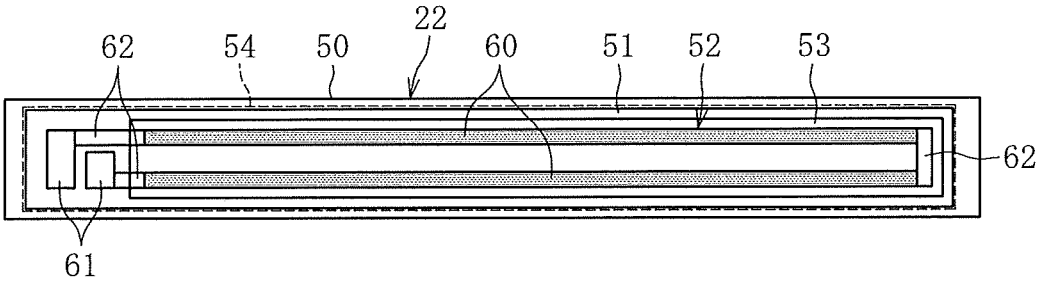
FIG. 7 is a plan view of a heater incorporated in the heating device depicted in FIG. 6.
Figure 8:
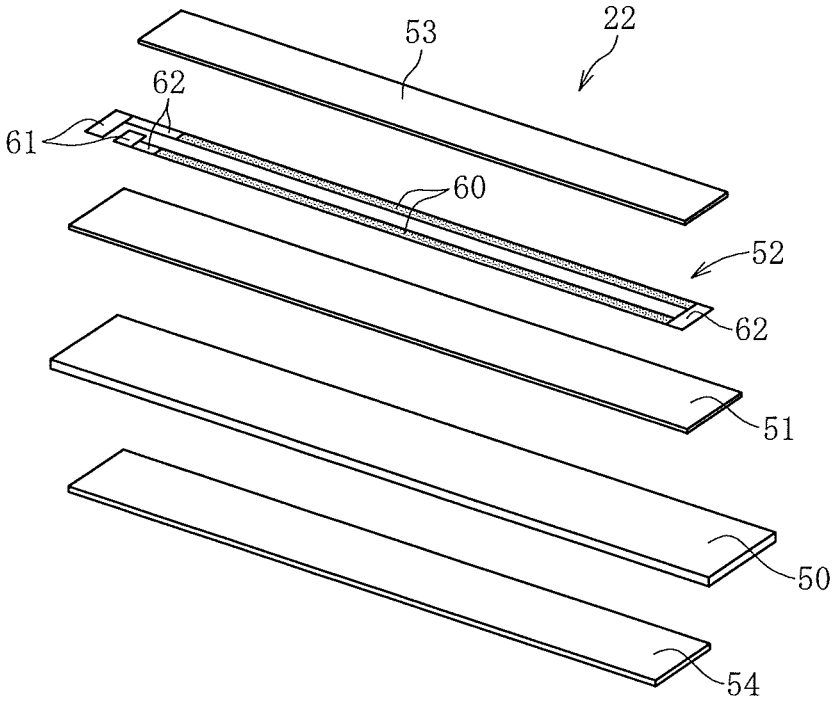
FIG. 8 is an exploded perspective view of the heater depicted in FIG. 7.

FIG. 7 is a plan view of the heater 22. FIG. 8 is an exploded perspective view of the heater 22.

Hereinafter, a front side of the heater 22 defines a side that faces the fixing belt 20 and the fixing nip N. A back side of the heater 22 defines a side that faces the heater holder 23.

As illustrated in FIGS. 7 and 8, the heater 22 is constructed of a plurality of layers, that is, the base layer 50, the first insulating layer 51, the conductor layer 52, the second insulating layer 53, and the third insulating layer 54, which are laminated. The base layer 50 is platy. The first insulating layer 51 is mounted on the front side of the base layer 50. The conductor layer 52 is mounted on the front side of the first insulating layer 51. The second insulating layer 53 coats the front side of the conductor layer 52. The third insulating layer 54 is mounted on the back side of the base layer 50. The conductor layer 52 includes a pair of heat generators 60, a pair of electrodes 61, and a plurality of feeders 62. Each of the heat generators 60 includes a laminated, resistive heat generator. Each of the electrodes 61 is coupled to one lateral end of each of the heat generators 60 in a longitudinal direction thereof through the feeder 62. The plurality of feeders 62 includes feeders, each of which couples the electrode 61 to the heat generator 60, and a feeder that couples the heat generators 60. As illustrated in FIG. 7, at least a part of each of the electrodes 61 is not coated with the second insulating layer 53 and is exposed so that the electrodes 61 are connected to the connector described below.

For example, each of the heat generators 60 is produced as below. Silver-palladium (AgPd), glass powder, and the like are mixed into paste. The paste coats the base layer 50 by screen printing or the like. Thereafter, the base layer 50 is subject to firing. Alternatively, the heat generator 60 may be made of a resistive material such as a silver alloy (AgPt) and ruthenium oxide ($RuO_2$). According to this embodiment, the heat generators 60 are parallel to each other and extended in a longitudinal direction of the base layer 50. One end (e.g., a right end in FIG. 7) of one of the heat generators 60 is electrically connected to one end of another one of the heat generators 60 through the feeder 62. Another end (e.g., a left end in FIG. 7) of each of the heat generators 60 is electrically connected to the electrode 61 through another feeder 62. The feeders 62 are made of a conductor having a resistance value smaller than a resistance value of the heat generators 60. The feeders 62 and the electrodes 61 are made of a material prepared with silver (Ag), silver-palladium (AgPd), or the like by screen printing or the like.

The base layer 50 is made of metal such as stainless steel (e.g., SUS stainless steel), iron, and aluminum. Instead of metal, the base layer 50 may be made of ceramic, glass, or the like. If the base layer 50 is made of an insulating material such as ceramic, the first insulating layer 51 sandwiched between the base layer 50 and the conductor layer 52 may be omitted. Since metal has an enhanced durability against rapid heating and is processed readily, metal is preferably used to reduce manufacturing costs. Among metals, aluminum and copper are preferable because aluminum and copper attain an increased thermal conductivity and barely suffer from uneven temperature. Stainless steel is advantageous because stainless steel is manufactured at reduced costs compared to aluminum and copper.

Each of the first insulating layer 51, the second insulating layer 53, and the third insulating layer 54 is made of heat resistant glass. Alternatively, each of the first insulating layer 51, the second insulating layer 53, and the third insulating layer 54 may be made of ceramic, PI, or the like.

Figure 9:
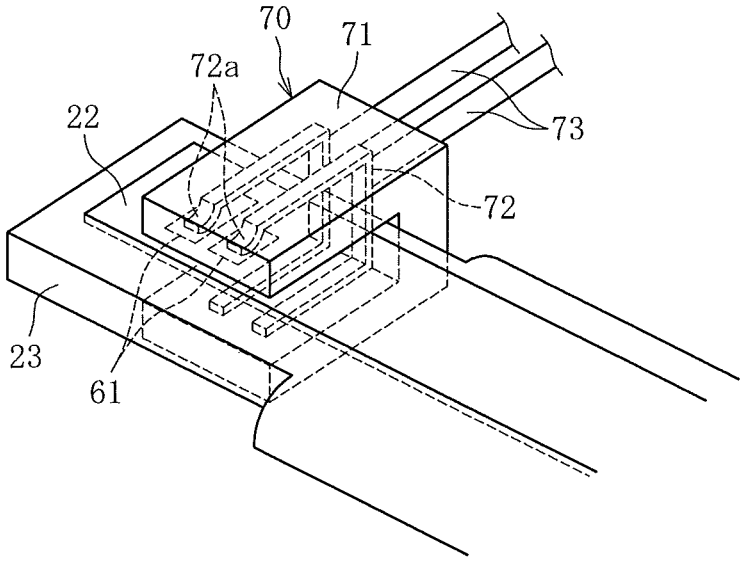
FIG. 9 is a perspective view of the heater and a heater holder incorporated in the heating device depicted in FIG. 6, illustrating a connector attached to the heater and the heater holder.

FIG. 9 is a perspective view of the heater 22 and the heater holder 23, illustrating a connector 70 attached thereto. The connector 70 serves as a feeding member.

As illustrated in FIG. 9, the connector 70 includes a housing 71 made of resin and a contact terminal 72 anchored to the housing 71. The contact terminal 72 is a flat spring. The contact terminal 72 includes a pair of contacts 72*a* that contacts the electrodes 61 of the heater 22, respectively. The contact terminal 72 of the connector 70 is coupled to a harness 73 that supplies power.

As illustrated in FIG. 9, the connector 70 is attached to the heater 22 and the heater holder 23 such that the connector 70 sandwiches the heater 22 and the heater holder 23 together at the front side and the back side, respectively. Accordingly, each of the contacts 72*a* of the contact terminal 72 resiliently contacts or presses against the electrode 61 of the heater 22.

Consequently, the heat generators 60 are electrically connected to a power supply disposed in the image forming apparatus 100 through the connector 70, allowing the power supply to supply power to the heat generators 60.

In order to retain proper conductivity between the contacts 72*a* of the connector 70 and the electrodes 61, respectively, for an extended period of time, contact pressure with which the connector 70 contacts the electrodes 61 is requested to be retained appropriately. However, the connector 70 may suffer from temperature increase (e.g., overheating) by hot air generated by the heater 22, heat conducted from the heater 22 through contact portions (e.g., the electrodes 61) where the connector 70 contacts the heater 22, and the like. Accordingly, if the connector 70 does not have a sufficient creep resistance, the connector 70 may suffer from creep deformation as the temperature of the connector 70 increases, thus contacting the electrodes 61 with decreased pressure. Hence, in order to retain conduction between the connector 70 and the electrodes 61 appropriately for an extended period of time, a mechanism to suppress temperature increase of the connector 70 is requested.

Although temperature increase of the connector 70 is caused mainly by heat generated by the heater 22, heat generation of the connector 70 while the connector 70 is energized is also one of causes of temperature increase of the connector 70. Hence, if heat generation of the connector 70 in accordance with energization of the connector 70 decreases, temperature increase of the connector 70 may be suppressed.

To address this circumstance, the connector 70 according to this embodiment is made of a corson copper alloy. The corson copper alloy contains copper (Cu) as a main ingredient and is a copper alloy (e.g., a Cu—Ni—Si alloy) containing at least nickel (Ni) and silicon (Si). Alternatively, in addition to copper, nickel, and silicon, the corson copper alloy may contain at least any one of tin (Su), zinc (Zn), magnesium (Mg), and manganese (Mn).

A conductivity of the corson copper alloy is greater than a conductivity of beryllium copper generally used for connectors. That is, a resistance value of the corson copper alloy is smaller than a resistance value of beryllium copper, attaining suppressed heat generation while the connector 70 is energized. Accordingly, the connector 70 made of the corson copper alloy decreases heat generation of the connector 70 while the connector 70 is energized, suppressing temperature increase of the connector 70.

If the contact portions (e.g., the electrodes 61) of the heater 22, that contact the connector 70, are made of silver or a silver alloy, contact portions (e.g., the contacts 72*a* of the contact terminal 72) of the connector 70, that contact the heater 22, are preferably coated with silver or the silver alloy. Accordingly, galvanic corrosion caused by contact between different metal materials is suppressed. If the heat generators 60 are produced by printing and firing paste prepared with a silver-palladium alloy, the contact portions of the connector 70 and the heater 22 are made of silver or the silver alloy without gold plating or the like, reducing manufacturing costs.

Figure 10:
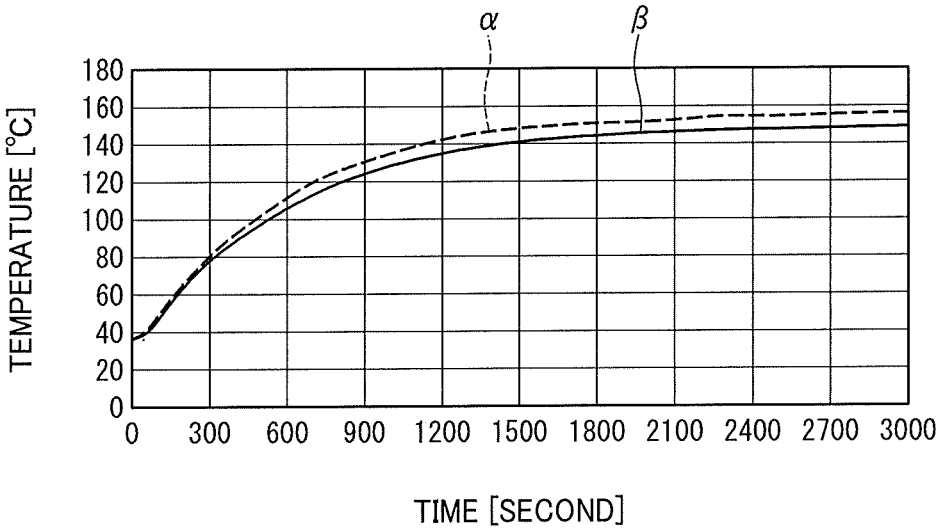
FIG. 10 is a graph illustrating comparison in temperature change between a connector according to an embodiment of the present disclosure and a connector according to a comparative example.

FIG. 10 illustrates comparison in temperature change between a corson copper alloy connector that is equivalent to the connector 70 according to the above-described embodiment and made of the corson copper alloy and a comparative connector according to a comparative example, that is made of beryllium copper.

The temperature change in FIG. 10 illustrates results of a test conducted as below to examine temperature change. Each of the corson copper alloy connector and the comparative connector was placed similarly at a position in proximity to a driving force transmission gear coupled to a pressure roller disposed in fixing devices having an identical construction. 2,500 sheets of A4 size in portrait orientation, that had a ream weight of 90 kg as a weight of 1,000 sheets of paper, such as cards and postcards, were printed at a print speed of 50 sheets per minute (50 ppm) as a single set. When printing was performed for 10 sets, the temperature of each of the corson copper alloy connector and the comparative connector, that is presented by a vertical axis, was measured as time elapsed as presented by a horizontal axis. In FIG. 10, a dotted line α indicates temperature change of the comparative connector. A solid line β indicates temperature change of the corson copper alloy connector.

As illustrated in FIG. 10 with the dotted line α, the temperature of the comparative connector increased to 160 degrees Celsius. Conversely, as illustrated with the solid line β, the temperature of the corson copper alloy connector increased to 150 degrees Celsius. It is assumed that the corson copper alloy connector made of the corson copper alloy attained suppressed heat generation while the corson copper alloy connector was energized compared to the comparative connector made of beryllium copper.

Figure 11:
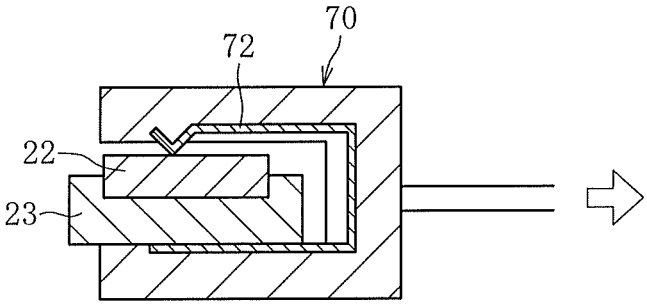
FIG. 11 is a cross-sectional view of the connector depicted in FIG. 9, illustrating a method for measuring contact pressure of the connector.

In addition to the above-described test to examine temperature change of the corson copper alloy connector and the comparative connector, a test to examine contact pressure change of the corson copper alloy connector and the comparative connector was conducted. The contact pressure change was evaluated by measuring a drawing force of the corson copper alloy connector and the comparative connector before temperature increase, that is, before the test started, and after temperature increase, that is, after the test finished. For example, as illustrated in FIG. 11, in a state in which the connector 70 sandwiched the heater 22 and the heater holder 23 together, the connector 70 was pulled out. A force gauge measured a maximum static friction force generated as the connector 70 was pulled and started moving. The maximum static friction force was calculated by multiplying contact pressure of the connector 70 by coefficient of friction. Table 1 below illustrates results of the test.

TABLE 1

| | Corson copper alloy connector | Comparative connector |
|---|---|---|
| Before temperature increase | 2.2N | 2.3N |
| After temperature increase | 2.1N | 1.8N |

As illustrated in Table 1, the maximum static friction force of the corson copper alloy connector before temperature increase was 2.2 N. The maximum static friction force of the corson copper alloy connector after temperature increase was 2.1 N. Thus, the drawing force barely changed before and after temperature increase. Conversely, the maximum static friction force of the comparative connector before temperature increase was 2.3 N. The maximum static friction force of the comparative connector after temperature increase was 1.8 N. Thus, the drawing force decreased by 0.5 N. An identical coefficient of friction was set to the corson copper alloy connector and the comparative connector. Accordingly, a difference in the drawing force indicated a difference in contact pressure with which the corson copper alloy connector and the comparative connector contacted heaters, respectively. The test provided a result that the contact pressure of the corson copper alloy connector decreased less than the contact pressure of the comparative connector.

As the results of the tests indicate, the corson copper alloy connector made of the corson copper alloy decreases heat generation while the corson copper alloy connector is energized, compared to the comparative connector made of beryllium copper, thus suppressing temperature increase of the corson copper alloy connector and thereby suppressing decrease in contact pressure of the corson copper alloy connector due to creep deformation. Accordingly, the connector 70 that is equivalent to the corson copper alloy connector and made of the corson copper alloy retains proper contact pressure with which the connector 70 contacts the electrodes 61 for an extended period of time, attaining stable conductivity and enhancing reliability.

For example, in a fixing device adapted to high speed printing, a heater is supplied with power of 1,000 W (e.g., at 100 V under 10 A) or more, or power of 1,300 W or more when the heater is supplied with power in a greater amount. Accordingly, a connector generates heat in a substantial amount as the connector is supplied with power. Thus, in the fixing device adapted to high speed printing, temperature increase of the connector is more serious. Hence, the connector 70 according to this embodiment is preferably employed to suppress temperature increase of the connector 70.

In a first configuration as one example, a length K of the heat generator 60 of the heater 22 in the longitudinal direction thereof is greater than a length (e.g., a maximum sheet width Wmax) of a sheet P, serving as a recording medium or a conveyed medium, of a maximum size available in the fixing device 9, as described below with reference to FIG. 13. The length K defines a conveyance span where the sheet P of the maximum size is conveyed. In a second configuration as another example, the heat generator 60 of the heater 22 has a positive temperature coefficient (PTC) property, that is, a positive temperature coefficient of resistance, and an electric current flows through at least a part of the heat generator 60 in the longitudinal direction of the heater 22. In those configurations also, the connector 70 according to this embodiment is preferably employed.

For example, in the first configuration in which the length K of the heat generator 60 is greater than the maximum sheet width Wmax in the longitudinal direction of the heater 22, the temperature of the heat generator 60 may increase substantially in a non-conveyance span where the sheet P is not conveyed, causing the connector 70 disposed opposite one lateral end of the heater 22 in the longitudinal direction thereof to be subject to temperature increase by heat generated in the non-conveyance span.

In the second configuration in which the heat generator 60 has the PTC property and the electric current flows through at least a part of the heat generator 60 in the longitudinal direction of the heater 22, if the temperature of the heat generator 60 increases in the non-conveyance span, the resistance value of the heat generator 60 increases in the non-conveyance span. Accordingly, temperature increase of the heat generator 60 in the non-conveyance span accelerates, causing the connector 70 to be subject to temperature increase.

Figure 12:
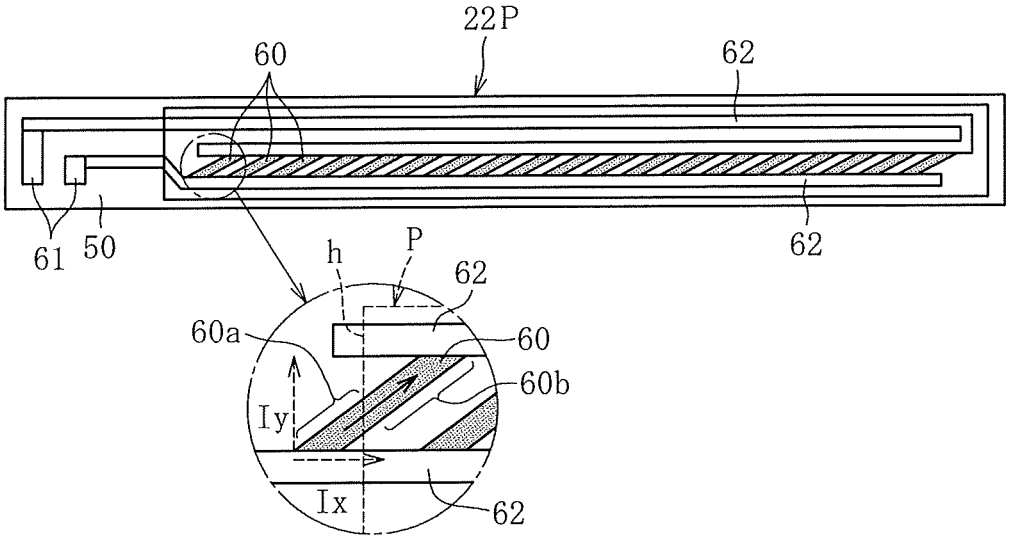
FIG. 12 is a plan view of a heater installable in the heating device depicted in FIG. 6, that incorporates heat generators connected in parallel.

Temperature increase resulting from the PTC property is not limited to a pattern in which the two heat generators 60 are connected in series as illustrated in FIG. 7. FIG. 12 illustrates a heater 22P incorporating the heat generators 60 connected in parallel. For example, temperature increase resulting from the PTC property may occur similarly also in a pattern in which the heat generators 60 are connected in parallel as illustrated in FIG. 12, at least if the heat generators 60 have a component Ix that flows an electric current in the longitudinal direction of the heat generators 60. FIG. 12 also illustrates a component Iy that flows the electric current in a direction perpendicular to a longitudinal direction of the heater 22P.

For example, as illustrated in an enlarged view enclosed by an alternate long and short dash line in FIG. 12, when a sheet P is conveyed over the fixing belt 20 such that an edge h of the sheet P in the width direction thereof passes from one end of the single heat generator 60 to another end of the single heat generator 60, the electric current flows from a non-conveyance region 60*a* of the heat generator 60 where the sheet P is not conveyed and therefore the temperature is high to a conveyance region 60*b* where the sheet P is conveyed and therefore the temperature is low, similarly to the pattern in which the heat generators 60 are connected in series. Accordingly, a heat generation amount of the non-conveyance region 60*a* is greater than a heat generation amount of the conveyance region 60*b*, accelerating temperature increase of the connector 70. Hence, in the configurations described above in which temperature increase of the heat generators 60 are substantial or accelerated in the non-conveyance region 60*a*, the connector 70 according to this embodiment is employed to achieve substantial advantages.

The connector 70 decreases heat generation thereof while the connector 70 is supplied with power, allowing employment of various layouts described below advantageously.

Figure 13:
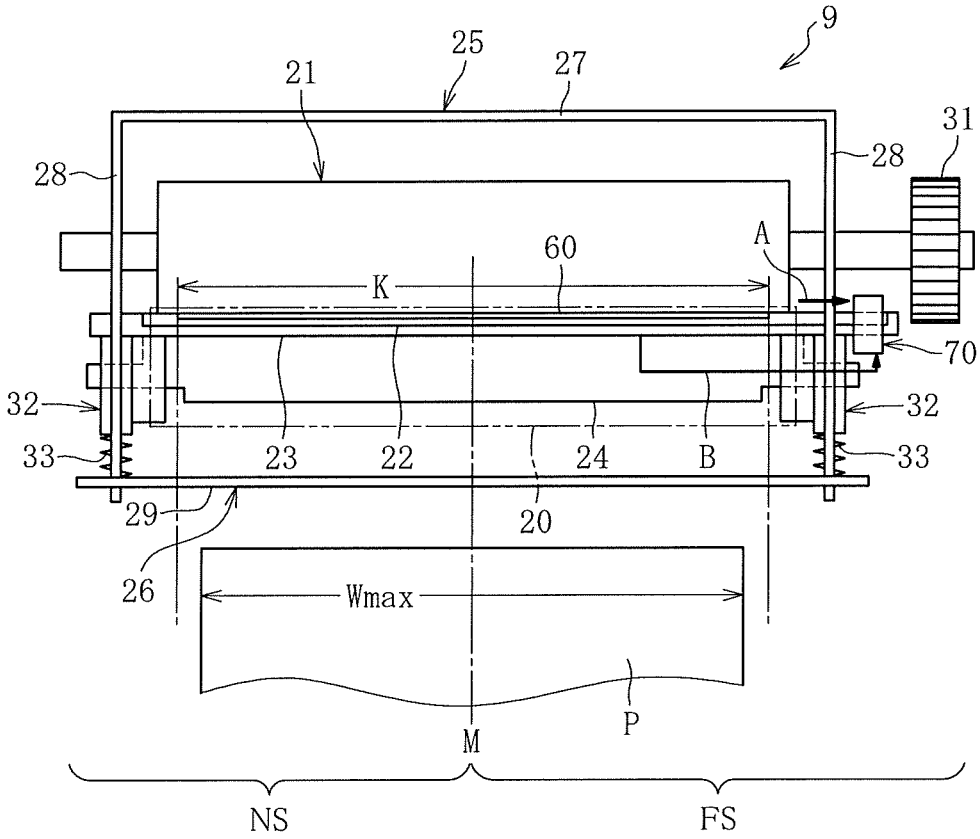
FIG. 13 is a plan view of the fixing device depicted in FIG. 2, illustrating one example of a layout of the fixing device.

As illustrated in FIG. 13 as one example, the driving force transmission gear 31 is disposed at one lateral end of the pressure roller 21 in the axial direction thereof. The driving force transmission gear 31 and the connector 70 are disposed in an identical side (e.g., a right side in FIG. 13), that is, a feeding side FS, defined by a center M of the heat generators 60 in the longitudinal direction of the heater 22.

In the feeding side FS, the driving force transmission gear 31 meshes with the gear disposed inside the body 103 of the image forming apparatus 100, generating heat. Accordingly, an ambient temperature in the feeding side FS is subject to a temperature higher than an ambient temperature of a non-feeding side NS opposite the feeding side FS in the longitudinal direction of the heater 22. Additionally, in a model of the fixing device 9, that is adapted to high speed printing, in order to increase a length of the fixing nip N in a sheet conveyance direction, the elastic layer 21*b*, serving as a viscoelastic layer, of the pressure roller 21 is requested to be compressed substantially at the fixing nip N. As the elastic layer 21*b* is compressed, the elastic layer 21*b* is deformed viscoelastically, increasing torque that increases an amount of heat generated at the driving force transmission gear 31.

Additionally, while the fixing belt 20 slides over the heater 22, a frictional resistance generates, increasing torque that increases the amount of heat generated at the driving force transmission gear 31. Hence, if the connector 70 generates an increased amount of heat as the connector 70 is supplied with power, the connector 70 is not preferably disposed in proximity to the driving force transmission gear 31 that generates heat. To address this circumstance, the connector 70 according to this embodiment is made of the corson copper alloy to decrease heat generation of the connector 70 while the connector 70 is energized. Hence, the connector 70 is disposed in the feeding side FS where the driving force transmission gear 31 that generates heat is disposed.

As illustrated in FIG. 13, the connector 70 made of the corson copper alloy allows the stay 24 to extend in the longitudinal direction thereof such that one lateral end (e.g., a right end in FIG. 13) of the stay 24 in the longitudinal direction thereof is disposed opposite the connector 70 or extended outboard beyond the connector 70 in the longitudinal direction of the heater 22.

Heat is conducted from the heater 22 to the connector 70 directly through a path indicated with an arrow A in FIG. 13. Additionally, heat is conducted from the heater 22 to the stay 24 through the heater holder 23, increasing an ambient temperature of a periphery of the stay 24. Heat is conducted from the periphery of the stay 24 to the connector 70 through a path indicated with an arrow B in FIG. 13. Accordingly, if the stay 24 extends to a position where the stay 24 is disposed opposite the connector 70 or a position where the stay 24 is in proximity to the connector 70, the connector 70 is susceptible to heat conducted through the stay 24. For example, if the stay 24 is made of a material having a thermal conductivity greater than a thermal conductivity of the heater holder 23, the connector 70 is more susceptible to heat conducted through the stay 24. Hence, if the connector 70 generates an increased amount of heat as the connector 70 is supplied with power, the stay 24 is not preferably disposed in proximity to the connector 70.

To address this circumstance, the connector 70 according to this embodiment is made of the corson copper alloy to decrease heat generation of the connector 70 while the connector 70 is energized, allowing the stay 24 to be disposed opposite the connector 70 or extended outboard beyond the connector 70 in the longitudinal direction of the heater 22.

Since the stay 24 extends to the position where the stay 24 is disposed opposite the connector 70 or extends outboard beyond the connector 70 in the longitudinal direction of the heater 22, the support 32 that supports the stay 24 has an increased width in the longitudinal direction of the stay 24. Accordingly, the spring 33 that biases the stay 24 via the support 32 has an increased diameter. Consequently, the fixing device 9 employs the spring 33 that presses against the support 32 with increased pressure, increasing the length of the fixing nip N in the sheet conveyance direction and thereby attaining high speed printing.

Figure 14:
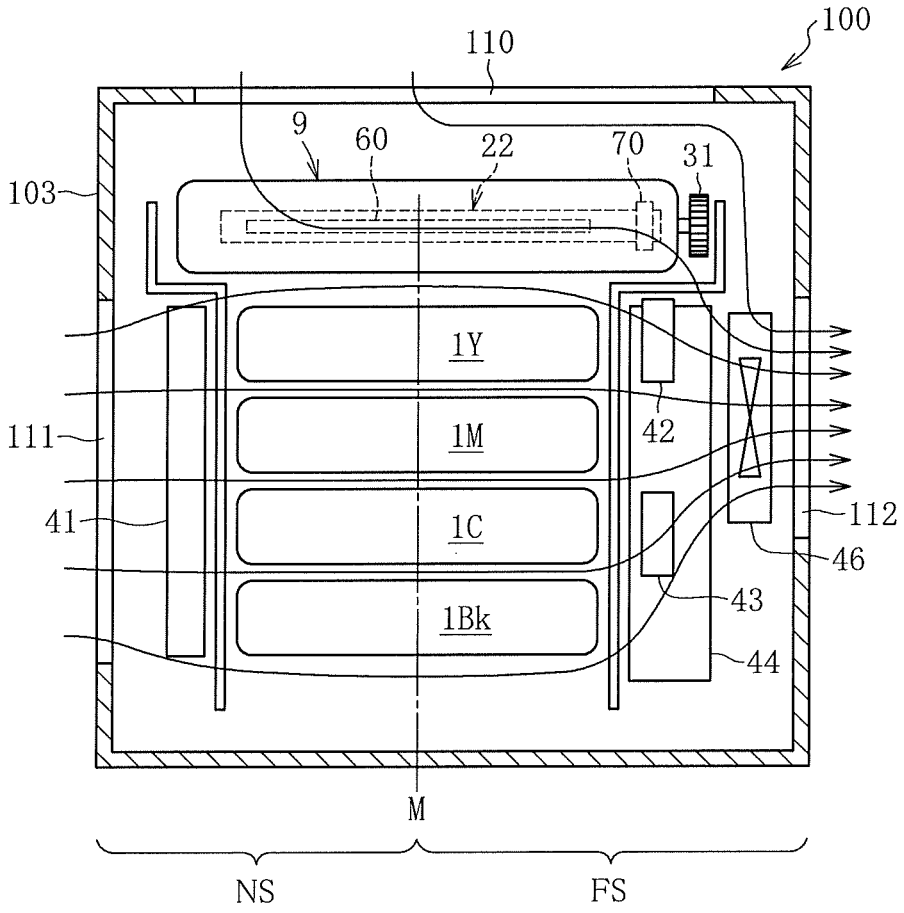
FIG. 14 is a plan view of the image forming apparatus depicted in FIG. 1, illustrating one example of a layout inside a body of the image forming apparatus.

FIG. 14 is a plan view of the image forming apparatus 100, illustrating one example of a layout inside the body 103 of the image forming apparatus 100.

According to the example of the image forming apparatus 100 illustrated in FIG. 14, a high voltage board 41 that supplies power to the chargers 3 and the like of the image forming units 1Y, 1M, 1C, and 1Bk, respectively, is disposed on the left of the image forming units 1Y, 1M, 1C, and 1Bk in FIG. 14. Conversely, a fixing motor 42, an image forming motor 43, and a power supply 44 are disposed on the right of the image forming units 1Y, 1M, 1C, and 1Bk in FIG. 14. The fixing motor 42 serves as a fixing driver that drives the elements of the fixing device 9 such as the pressure roller 21. The image forming motor 43 serves as an image forming driver that drives the photoconductor 2, the developing device 4, and the like of each of the image forming units 1Y, 1M, 1C, and 1Bk. The power supply 44 is a power supply unit (PSU) that supplies power to the fixing motor 42, the image forming motor 43, the heater 22 of the fixing device 9, and the like.

The fixing motor 42, the image forming motor 43, and the power supply 44 that are disposed on the right of the image forming units 1Y, 1M, 1C, and 1Bk generate heat as the fixing motor 42, the image forming motor 43, and the power supply 44 are driven or supplied with power. To address this circumstance, the connector 70 according to this embodiment is made of the corson copper alloy to decrease heat generation of the connector 70 while the connector 70 is energized. Accordingly, the connector 70, together with the fixing motor 42, the image forming motor 43, and the power supply 44 that generate heat, is disposed in an identical side, that is, the feeding side FS, defined by the center M of the heat generators 60 in the longitudinal direction thereof.

Thus, the connector 70, the fixing motor 42, the image forming motor 43, and the power supply 44 are disposed in the identical side, shortening a harness and the like that electrically connect the connector 70, the fixing motor 42, the image forming motor 43, and the power supply 44. Accordingly, the image forming apparatus 100 is manufactured at reduced costs and assembled readily. Alternatively, the power supply 44 may be orientated such that a longitudinal direction of the power supply 44 is parallel to the longitudinal direction of the heater 22. In this case, the power supply 44 may be disposed in proximity to the connector 70 such that a center of the power supply 44 in the longitudinal direction thereof is situated closer to the connector 70 than the center M of the heat generators 60 in the longitudinal direction thereof is.

According to the example of the image forming apparatus 100 illustrated in FIG. 14, a fan 46 serving as an exhaust fan is disposed inside the body 103 of the image forming apparatus 100. An inlet 110 is disposed in a front cover (e.g., an upper cover in FIG. 14) of the body 103 of the image forming apparatus 100. An inlet 111 is disposed in one of both side covers (e.g., a left side cover in FIG. 14) of the body 103 of the image forming apparatus 100. An outlet 112 is disposed in another one of both side covers (e.g., a right side cover in FIG. 14) of the body 103 of the image forming apparatus 100. As the fan 46 is driven by power supplied from the power supply 44, air flow indicated with arrows in FIG. 14 generates inside the body 103 of the image forming apparatus 100. Air enters from the outside of the image forming apparatus 100 into the body 103 of the image forming apparatus 100 through each of the inlets 110 and 111. Air is exhausted from the body 103 of the image forming apparatus 100 through the outlet 112. While air passes inside the body 103 of the image forming apparatus 100, air draws heat from the fixing device 9, the fixing motor 42, the image forming motor 43, the power supply 44, and the like and is exhausted. Thus, air cools the fixing device 9, the fixing motor 42, the image forming motor 43, the power supply 44, and the like, suppressing temperature increase thereof.

Since air passing inside the body 103 of the image forming apparatus 100 absorbs heat inside the body 103, a temperature at a position in proximity to the outlet 112 is higher than temperatures at positions in proximity to the inlets 110 and 111, respectively. Hence, if the connector 70 is situated at the position in proximity to the outlet 112, air heated to a high temperature heats the connector 70. For example, if the image forming apparatus 100 is a model adapted to high speed printing, the image forming apparatus 100 generates an increased amount of heat inside the body 103 thereof, causing serious temperature increase in a periphery of the connector 70. A cover of the fixing device 9 has a gear slot disposed opposite the driving force transmission gear 31 mounted on the pressure roller 21. The driving force transmission gear 31 is coupled to the gear disposed inside the body 103 of the image forming apparatus 100 through the gear slot. The fixing device 9 also has a sheet slot through which a sheet P is conveyed into the fixing device 9. As hot air moves from the sheet slot to the gear slot, the temperature inside the fixing device 9 increases. To address this circumstance, the fan 46 may increase air flow, for example, to decrease the temperature inside the fixing device 9. However, noise and the size of the image forming apparatus 100 may increase disadvantageously.

In view of those circumstances and temperature increase of the connector 70, the connector 70 is not preferably disposed in proximity to the outlet 112. To address this circumstance, the connector 70 according to this embodiment is made of the corson copper alloy to decrease heat generation of the connector 70 while the connector 70 is energized. Hence, the connector 70 is disposed in proximity to the outlet 112 that might be subject to hot air. FIG. 14 illustrates an example of the image forming apparatus 100 in which the connector 70 and the outlet 112 are disposed in an identical side, that is, the feeding side FS, defined by the center M of the heat generators 60 in the longitudinal direction thereof. Accordingly, the fan 46 disposed in proximity to the outlet 112 is also disposed in the identical side, that is, the feeding side FS, defined by the center M of the heat generators 60 in the longitudinal direction thereof, where the connector 70 is disposed. Consequently, according to the example of the image forming apparatus 100 illustrated in FIG. 14, the fan 46 and the power supply 44 are disposed in the identical side, that is, the feeding side FS, shortening the harness and the like that electrically connect the power supply 44 to the fan 46 and thereby facilitating assembly at reduced manufacturing costs.

Additionally, according to the example of the image forming apparatus 100 illustrated in FIG. 14, the outlet 112 is disposed in the right side cover in FIG. 14 of the body 103 of the image forming apparatus 100. Accordingly, hot air exhausted from the outlet 112 does not blow against a user of the image forming apparatus 100, who stands in front of the front cover of the body 103, thus enhancing comfort. For example, the outlet 112 is preferably disposed in a face other than a face that is faced by the user who operates the image forming apparatus 100 and is mounted with a controller such as a control panel.

Figure 15:
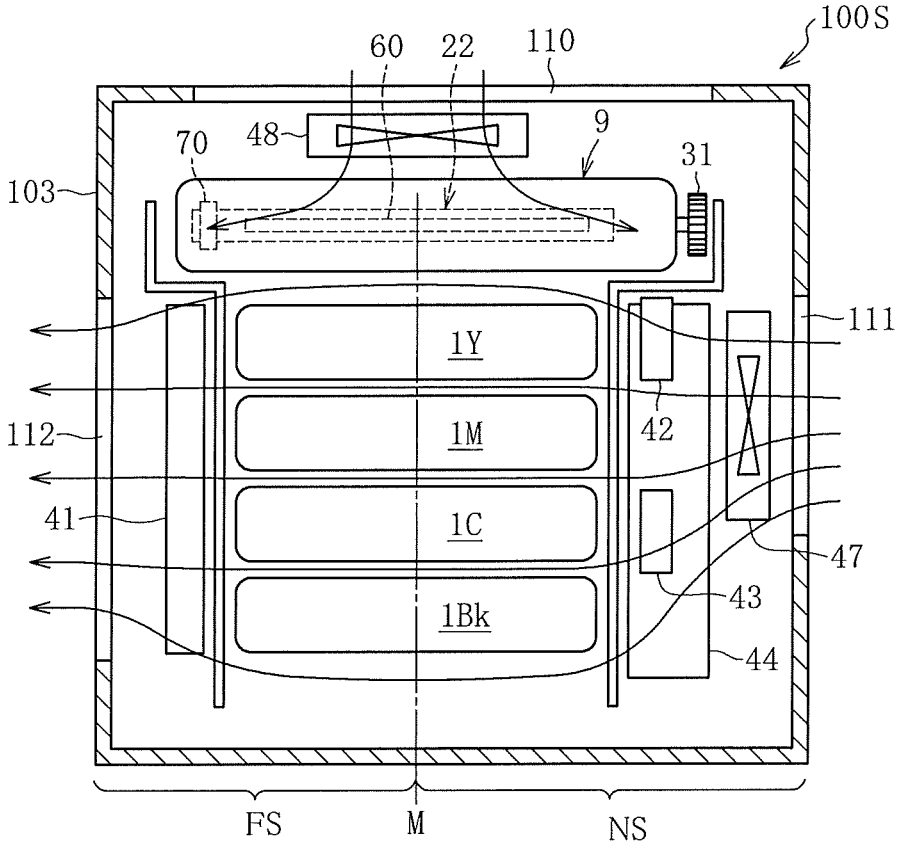
FIG. 15 is a plan view of an image forming apparatus as a variation of the image forming apparatus depicted in FIG. 1, illustrating another example of the layout inside the body.

FIG. 15 is a plan view of an image forming apparatus 100S, illustrating another example of the layout inside the body 103.

According to the example of the image forming apparatus 100S illustrated in FIG. 15, air flow is directed in a leftward direction opposite a rightward direction in which air flow is directed in the image forming apparatus 100 as described above with reference to FIG. 14. For example, according to the example of the image forming apparatus 100S illustrated in FIG. 15, a fan 47 serving as an intake fan intakes air from an outside of the image forming apparatus 100S through the inlet 111 disposed in the right side cover in FIG. 15. Air is exhausted from the body 103 of the image forming apparatus 100S through the outlet 112 disposed in the left side cover in FIG. 15. The temperature of air passing inside the body 103 of the image forming apparatus 100S is higher in the feeding side FS, that is, a left side in FIG. 15 than in the non-feeding side NS, that is, a right side in FIG. 15.

However, since the connector 70 is made of the corson copper alloy, the connector 70 is disposed in the left side in FIG. 15, that is, an identical side where the outlet 112 is disposed. The left side in FIG. 15 is the feeding side FS defined by the center M of the heat generators 60 in the longitudinal direction thereof. In view of a positional relation of the connector 70 with respect to the inlet 111 disposed on the right of the connector 70 in FIG. 15 and the fan 47 disposed in proximity to the inlet 111, the connector 70 is disposed in the feeding side FS defined by the center M of the heat generators 60 in the longitudinal direction thereof, that is opposite the non-feeding side NS where the inlet 111 and the fan 47 are disposed.

According to the example of the image forming apparatus 100S illustrated in FIG. 15, a fan 48 is disposed in proximity to the inlet 110 disposed in the front cover, that is, an upper cover in FIG. 15, of the body 103 of the image forming apparatus 100S, separately from the fan 47. The fan 48 blows air against a sheet guide 57 illustrated in FIG. 16 disposed above the fixing device 9, the sheet ejection device 10 disposed in a periphery of the sheet guide 57, and the like, thus cooling the sheet guide 57 and the sheet ejection device 10. Additionally, the fan 48 ventilates the sheet guide 57 and the periphery thereof, suppressing condensation. A part of air intaken through the inlet 110 disposed in the front cover is heated while passing through the fixing device 9 and is moved to the connector 70. However, since the connector 70 is made of the corson copper alloy that suppresses temperature increase of the connector 70, the connector 70 is used without faults.

Figure 16:
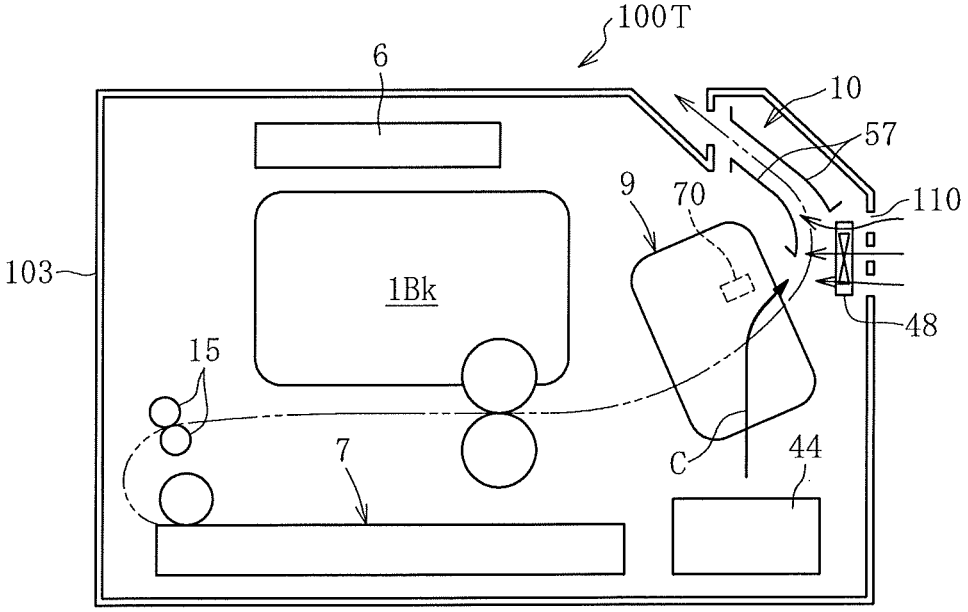
FIG. 16 is a side view of an image forming apparatus as another variation of the image forming apparatus depicted in FIG. 1, illustrating yet another example of the layout inside the body.

FIG. 16 is a plan view of an image forming apparatus 100T, illustrating yet another example of the layout inside the body 103.

As the power supply 44 disposed inside the body 103 of the image forming apparatus 100 generates heat, an ambience around the power supply 44, that is heated by the power supply 44, usually moves upward in a direction indicated with an arrow C in FIG. 16. Hence, if the power supply 44 is situated below the fixing device 9, the connector 70 disposed inside the fixing device 9 is susceptible to heat from the power supply 44. To address this circumstance, the connector 70 according to this embodiment is made of the corson copper alloy to decrease heat generation of the connector 70 while the connector 70 is energized. Hence, the power supply 44 is disposed below the fixing device 9 safely at a position where the power supply 44 overlaps the fixing device 9 in a gravity direction.

As described above, the connector 70 made of the corson copper alloy allows employment of various layouts of the image forming apparatuses 100, 100S, and 100T. For example, since the connector 70 decreases heat generation thereof as the connector 70 is supplied with power, the connector 70 is disposed in proximity to the driving force transmission gear 31, various motors (e.g., the fixing motor 42 and the image forming motor 43), the power supply 44, and the like that generate heat, thus improving flexibility in layout. Additionally, the connector 70 is disposed in proximity to a heat generating source such as the driving force transmission gear 31, downsizing the fixing device 9. Downsizing of the fixing device 9 is preferable and advantageous if the fixing device 9 is adapted to low speed printing and therefore requested to be downsized.

Figure 17:
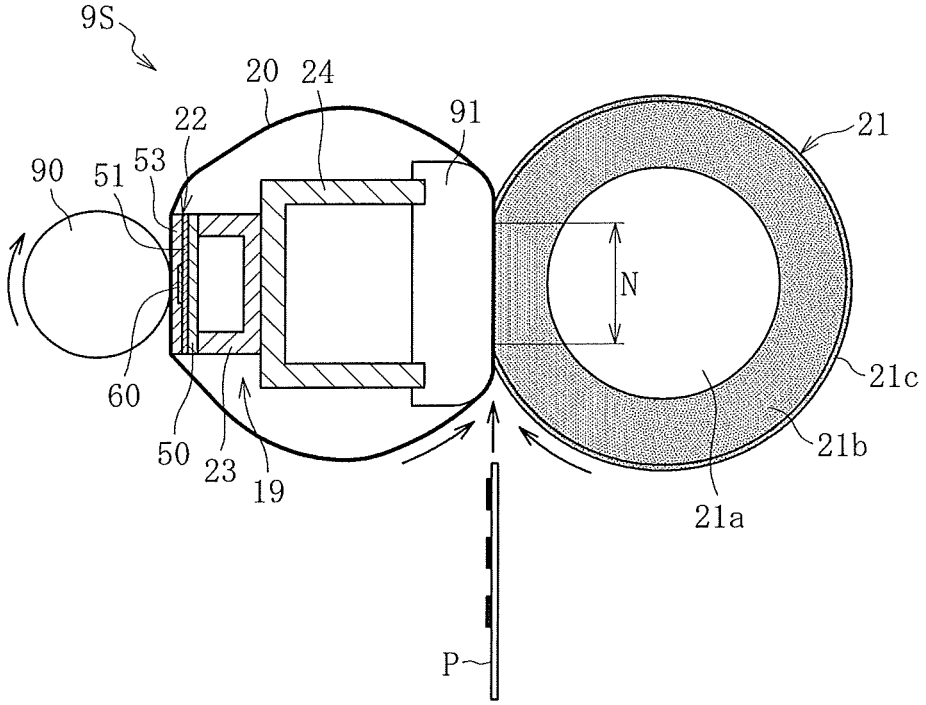
FIG. 17 is a schematic cross-sectional view of a fixing device installable in the image forming apparatus depicted in FIG. 1 as a first variation of the fixing device depicted in FIG. 2.
Figure 18:
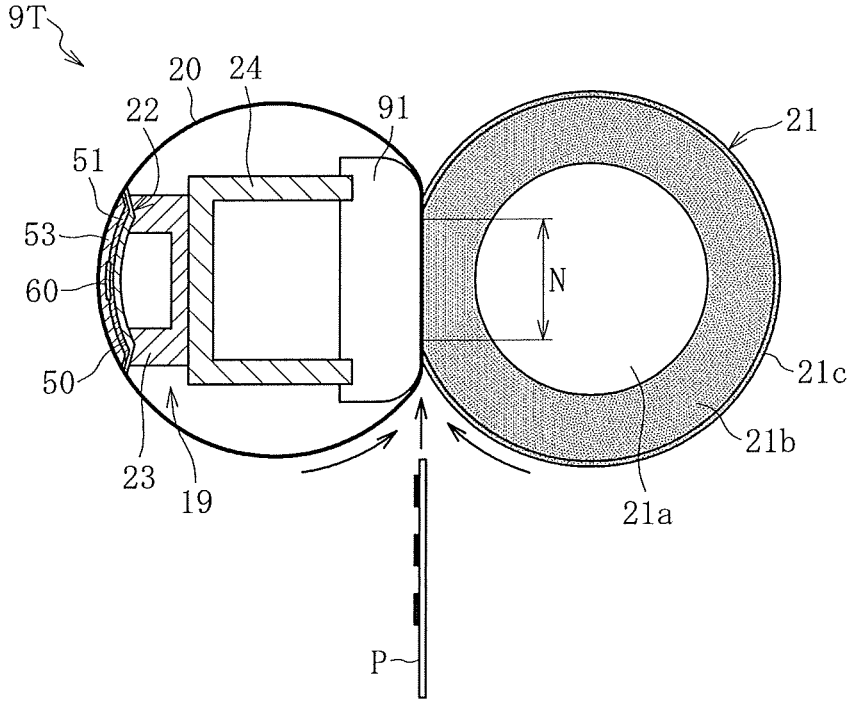
FIG. 18 is a schematic cross-sectional view of a fixing device installable in the image forming apparatus depicted in FIG. 1 as a second variation of the fixing device depicted in FIG. 2.
Figure 19:
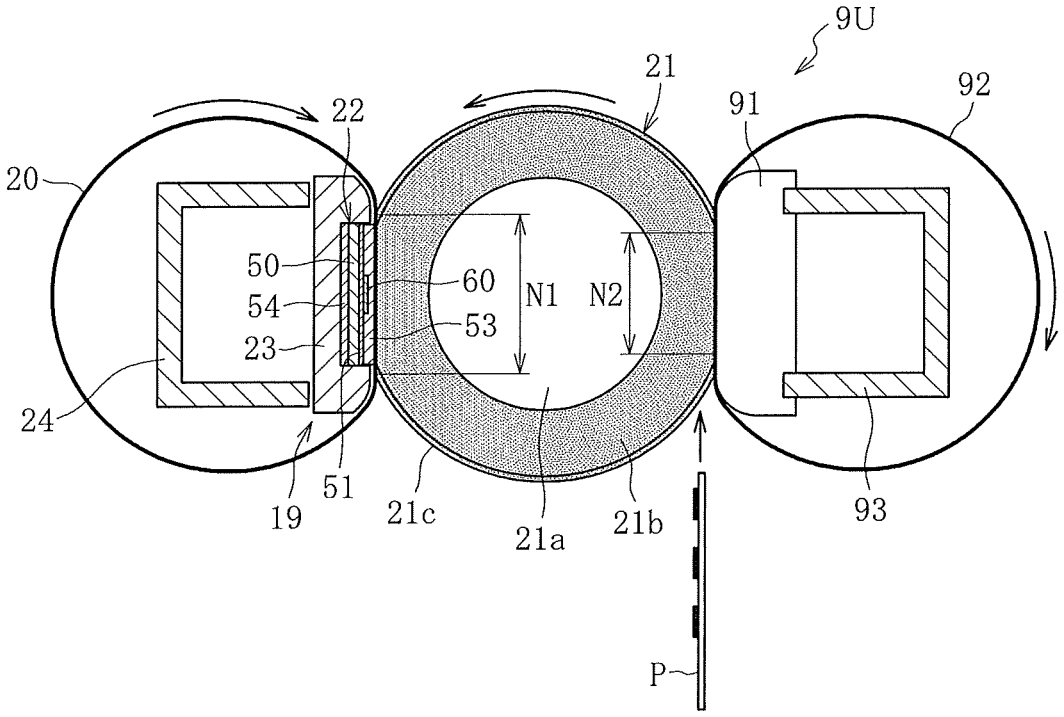
FIG. 19 is a schematic cross-sectional view of a fixing device installable in the image forming apparatus depicted in FIG. 1 as a third variation of the fixing device depicted in FIG. 2.

The embodiments of the present disclosure are applicable to fixing devices 9S, 9T, and 9U illustrated in FIGS. 17 to 19, respectively, other than the fixing device 9 described above. The following briefly describes a construction of each of the fixing devices 9S, 9T, and 9U depicted in FIGS. 17 to 19, respectively.

A description is provided of a construction of the fixing device 9S depicted in FIG. 17.

As illustrated in FIG. 17, the fixing device 9S includes a pressing roller 90 disposed opposite the pressure roller 21 via the fixing belt 20. The pressing roller 90 and the heater 22 sandwich the fixing belt 20 so that the heater 22 heats the fixing belt 20. On the other hand, the nip forming pad 91 is disposed inside the loop formed by the fixing belt 20 and disposed opposite the pressure roller 21. The stay 24 supports the nip forming pad 91. The nip forming pad 91 and the pressure roller 21 sandwich the fixing belt 20 and define the fixing nip N.

A description is provided of a construction of the fixing device 9T depicted in FIG. 18.

As illustrated in FIG. 18, the fixing device 9T does not include the pressing roller 90 described above with reference to FIG. 17. In order to attain a contact length for which the heater 22 contacts the fixing belt 20 in the circumferential direction thereof, the heater 22 is curved into an arc in cross section that corresponds to a curvature of the fixing belt 20. Other construction of the fixing device 9T is equivalent to that of the fixing device 9S depicted in FIG. 17.

A description is provided of a construction of the fixing device 9U depicted in FIG. 19.

As illustrated in FIG. 19, the fixing device 9U includes a pressure belt 92 in addition to the fixing belt 20. The pressure belt 92 and the pressure roller 21 form a fixing nip N2 serving as a secondary nip separately from a heating nip N1 serving as a primary nip formed between the fixing belt 20 and the pressure roller 21. For example, the nip forming pad 91 and a stay 93 are disposed opposite the fixing belt 20 via the pressure roller 21. The pressure belt 92 that is rotatable accommodates the nip forming pad 91 and the stay 93. As a sheet P bearing a toner image is conveyed through the fixing nip N2 formed between the pressure belt 92 and the pressure roller 21, the pressure belt 92 and the pressure roller 21 fix the toner image on the sheet P under heat and pressure. Other construction of the fixing device 9U is equivalent to that of the fixing device 9 depicted in FIG. 2.

The heaters 22 and 22P according to the embodiments of the present disclosure are also applicable to devices other than the fixing devices 9, 9S, 9T, and 9U. For example, the heaters 22 and 22P according to the embodiments of the present disclosure are also applicable to a dryer installed in an image forming apparatus employing an inkjet method. The dryer dries ink applied onto a sheet. Alternatively, the heaters 22 and 22P according to the embodiments of the present disclosure may be applied to a coater (e.g., a laminator) that thermally presses film serving as a coating member onto a surface of a sheet (e.g., paper) serving as a conveyed medium while a belt conveys the sheet. The heating device 99 according to the embodiments of the present disclosure is not limited to a belt heating device that heats a belt and may be a heating device that does not incorporate the belt.

A description is provided of advantages of a heating device (e.g., the heating device 99).

As illustrated in FIGS. 2, 9, and 12, the heating device includes a heater (e.g., the heaters 22 and 22P) and a feeding member (e.g., the connector 70). As illustrated in FIGS. 7 and 12, the heater is a laminated heater, for example. The heater includes a heat generator (e.g., the heat generator 60) that generates heat as the heat generator is supplied with power. The feeding member contacts the heater and feeds power to the heat generator. The feeding member is made of a corson copper alloy.

Since the feeding member is made of the corson copper alloy, the feeding member decreases heat generation thereof while the feeding member is energized, suppressing temperature increase of the feeding member.

According to the embodiments described above, the fixing belt 20 serves as an endless belt. Alternatively, a fixing film, a fixing sleeve, or the like may be used as an endless belt. Further, the pressure roller 21 serves as an opposed rotator. Alternatively, a pressure belt or the like may be used as an opposed rotator.

The above-described embodiments are illustrative and do not limit the present disclosure. Thus, numerous additional modifications and variations are possible in light of the above teachings. For example, elements and features of different illustrative embodiments may be combined with each other and substituted for each other within the scope of the present disclosure.

Any one of the above-described operations may be performed in various other ways, for example, in an order different from the one described above.

What is claimed is:

1. A heating device, comprising:

a laminated heater including a heat generator configured to generate heat as the heat generator is supplied with power; and a feeding member configured to contact the heater and feed the power to the heat generator, the feeding member being made of a corson copper alloy.

2. The heating device according to claim 1, wherein the heater further includes a first contact portion configured to contact the feeding member, the first contact portion being made of one of silver and a silver alloy, and wherein the feeding member includes a second contact portion configured to contact the heater, the second contact portion being coated with one of silver and a silver alloy.

3. The heating device according to claim 1, wherein the heat generator has a positive temperature coefficient property, and wherein an electric current flows through at least a part of the heat generator in a longitudinal direction of the heater.

4. The heating device according to claim 1, further comprising:

an endless belt configured to rotate, the endless belt configured to be heated by the heater;

a driving roller configured to contact an outer circumferential surface of the endless belt; and a driving force transmitter disposed at one lateral end of the driving roller in an axial direction of the driving roller, the driving force transmitter being configured to transmit a driving force that drives and rotates the driving roller, wherein the driving force transmitter is disposed in a feeding side defined by a center of the heat generator in a longitudinal direction of the heater, and the feeding side is where the feeding member is disposed.

5. The heating device according to claim 4, wherein the driving roller includes:

a cored bar; and a viscoelastic layer disposed on an outer periphery of the cored bar, and wherein the endless belt is pressed against the driving roller.

6. The heating device according to claim 4, wherein the heater further includes a nip former disposed opposite an inner circumferential surface of the endless belt, and wherein the nip former and the driving roller sandwich the endless belt to form a nip between the endless belt and the driving roller.

7. The heating device according to claim 4, wherein the endless belt rotates to convey a conveyed medium, and wherein a length of the heat generator is greater than a length of the conveyed medium in the longitudinal direction of the heater.

8. The heating device according to claim 1, further comprising:

a holder configured to hold the heater;

a reinforcement configured to reinforce the holder; and a biasing member configured to bias the reinforcement.

9. The heating device according to claim 8, wherein one lateral end of the reinforcement in a longitudinal direction of the reinforcement is disposed opposite the feeding member.

10. The heating device according to claim 8, wherein one lateral end of the reinforcement in a longitudinal direction of the reinforcement is disposed outboard beyond the feeding member in the longitudinal direction of the reinforcement.

11. The heating device according to claim 1, wherein the feeding member includes a connector.

12. A fixing device, comprising:

an endless belt configured to rotate;

an opposed rotator configured to contact the endless belt to form a fixing nip between the endless belt and the opposed rotator, the fixing nip through which a recording medium bearing an image is conveyed;

a laminated heater configured to heat the endless belt, the laminated heater including a heat generator configured to generate heat as the heat generator is supplied with power; and a feeding member configured to contact the laminated heater and feed the power to the heat generator, the feeding member being made of a corson copper alloy.

13. An image forming apparatus, comprising:

an image forming device configured to form an image; and a heating device configured to heat the image borne on a recording medium, the heating device including:

a laminated heater including a heat generator configured to generate heat as the heat generator is supplied with power; and a feeding member configured to contact the heater and feed the power to the heat generator, the feeding member being made of a corson copper alloy.

14. The image forming apparatus according to claim 13, further comprising:

a body;

an outlet disposed in the body; and an exhaust fan configured to exhaust air through the outlet, wherein the outlet and the exhaust fan are disposed in a feeding side defined by a center of the heat generator in a longitudinal direction of the heater, the feeding side where the feeding member is disposed.

15. The image forming apparatus according to claim 13, further comprising:

a body;

an inlet disposed in the body; and an intake fan configured to intake air through the inlet, wherein the inlet and the intake fan are disposed in a non-feeding side defined by a center of the heat generator in a longitudinal direction of the heater, the non-feeding side where the feeding member is not disposed.

16. The image forming apparatus according to claim 13, further comprising an image forming driver configured to drive the image forming device, the image forming driver being disposed in a feeding side defined by a center of the heat generator in a longitudinal direction of the heater, the feeding side where the feeding member is disposed.

17. The image forming apparatus according to claim 16, further comprising a power supply configured to supply the power to at least one of the image forming driver and the heater.

18. The image forming apparatus according to claim 17, wherein the power supply is disposed in the feeding side.

19. The image forming apparatus according to claim 17, wherein the power supply is disposed in proximity to the feeding member.

20. The image forming apparatus according to claim 17, wherein the power supply is disposed below the heating device.

* * * * *